US008963936B1

(12) United States Patent
Khoury et al.

(10) Patent No.: US 8,963,936 B1
(45) Date of Patent: Feb. 24, 2015

(54) METHOD AND APPARATUS FOR REFRESHING A DISPLAY

(75) Inventors: Rabeeh Khoury, Tarshiha (IL); Dan Ilan, Herzellia (IL); Guy Nakibly, Haifa (IL)

(73) Assignee: Marvell Israel (M.I.S.L) Ltd., Yokneam (IL)

( * ) Notice: Subject to any disclaimer, the term of this patent is extended or adjusted under 35 U.S.C. 154(b) by 319 days.

(21) Appl. No.: 12/977,815

(22) Filed: Dec. 23, 2010

Related U.S. Application Data

(60) Provisional application No. 61/290,741, filed on Dec. 29, 2009, provisional application No. 61/308,757, filed on Feb. 26, 2010.

(51) Int. Cl.
*G09G 5/36* (2006.01)
*G09G 5/00* (2006.01)

(52) U.S. Cl.
USPC ..... 345/531

(58) Field of Classification Search
CPC ... G09G 2360/06; G06F 3/0412; G06F 1/324; G06F 3/14
USPC ..... 345/531, 205
See application file for complete search history.

(56) References Cited

U.S. PATENT DOCUMENTS

| | | | | |
|---|---|---|---|---|
| 5,532,719 | A * | 7/1996 | Kikinis | 345/211 |
| 5,757,365 | A * | 5/1998 | Ho | 345/212 |
| 6,756,988 | B1 * | 6/2004 | Wang et al. | 345/558 |
| 6,970,163 | B2 * | 11/2005 | Cairns et al. | 345/213 |
| 7,982,705 | B2 * | 7/2011 | Morii | 345/100 |

* cited by examiner

*Primary Examiner* — Ke Xiao
*Assistant Examiner* — Whitney Pointe

(57) ABSTRACT

Aspects of the disclosure provide an apparatus. The apparatus includes a display module configured to display an image frame on a screen based on pixel data of the image frame, a memory chip configured to include a frame buffer that stores pixel data of image frames to be displayed by the display module and an integrated circuit, such as a system on chip (SOC). The integrated circuit includes a memory controller coupled to the memory chip and configured to access the memory chip to fetch the pixel data from the frame buffer in response to data requests, and a display controller coupled to the display module. The display controller is configured to send data requests to the memory controller to fetch the pixel data from the frame buffer and transmit the pixel data to the display module when the apparatus is in a first mode, such as an active mode. Further, the display controller is configured to selectively drop a portion of the data requests to increase an idle time of the memory chip when the apparatus enters a second mode, such as an e-book mode, so that the memory chip enters a memory power saving mode when the apparatus is in the second mode.

18 Claims, 8 Drawing Sheets

METHOD AND APPARATUS FOR REFRESHING A DISPLAY

INCORPORATION BY REFERENCE

This application claims the benefit of U.S. Provisional Applications No. 61/290,741, "Method of Refreshing LCD Display in Low Power Modes" filed on Dec. 29, 2009, and No. 61/308,757, "Method of Refreshing LCD Display in Low Power Modes" filed on Feb. 26, 2010, which are incorporated herein by reference in their entirety.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Displays, such as cathode ray tube (CRT), plasma display panel (PDP), liquid-crystal display (LCD) panel, and the like, generally refresh continuously during operation. In an example, an LCD panel is coupled to a frame buffer via a display controller. The frame buffer receives and stores pixel data corresponding to one or more images. During operation, new images are generated and stored in the frame buffer. The display controller continuously streams pixel data corresponding to images at a refresh rate, such as 60 images per second (60 Hz), from the frame buffer to the LCD panel. The LCD panel receives the pixel data stream, scans and drives pixels on a screen based on the pixel data stream. Thus, the displayed image on the screen refreshes 60 times per second, for example.

SUMMARY

Aspects of the disclosure provide an integrated circuit. The integrated circuit includes a memory controller coupled to a memory that includes a frame buffer storing pixel data of images for displaying, and a display controller coupled to a display module. The memory controller is configured to access the memory to fetch the pixel data from the frame buffer in response to data requests. The display controller is configured to send data requests to the memory controller to fetch the pixel data from the frame buffer and transmit the pixel data to the display module in a first mode, such as an active mode and to selectively drop a portion of the data requests to increase an idle time of the memory in a second mode, such as an e-book mode, so that the memory enters a memory power saving mode in the second mode.

Further, in an example, the integrated circuit includes a central processing unit (CPU) that is configured to be active in the first mode and is configured to be inactive in the second mode.

In an embodiment, the frame buffer stores a static image. The display controller is configured to drop the portion of the data requests to fetch pixel data of every second image frame. Further, the display controller enters a power saving mode in the second mode. Similarly, in an example, the memory controller enters a power saving mode in the second mode.

According to an aspect of the disclosure, the display controller selectively sends dummy vertical synchronization pulses/dummy horizontal synchronization pulses to the display module in the second mode. Further, the display controller selectively disables a data enable signal in the second mode. In an example, the display module is configured to detect the dummy vertical and horizontal synchronization pulses with disabled data transferring and to use the dummy vertical and horizontal synchronization pulses to keep frame synchronization.

Aspects of the disclosure provide a method for refreshing a display. The method includes sending first data requests to a memory controller to fetch pixel data of a first image frame from a memory, sending the fetched pixel data of the first image frame to a display module for display, and dropping second data requests corresponding to fetching pixel data of a second image frame, such that the memory has an increased idle time and enters a memory power saving mode.

In an embodiment, the memory stores a static image. In an example, a central processing unit (CPU) is inactive and does not change the image stored in the memory. The method includes dropping the second data requests corresponding to fetching the pixel data of the static image. For example, the second data requests correspond to fetching pixel data of every second image frame.

Aspects of the disclosure provide an apparatus. The apparatus includes a display module configured to display an image frame on a screen based on pixel data of the image frame, a memory chip configured to include a frame buffer that stores pixel data of image frames to be displayed by the display module and an integrated circuit, such as a system on chip (SOC). The integrated circuit includes a memory controller coupled to the memory chip and configured to access the memory chip to fetch the pixel data from the frame buffer in response to data requests, and a display controller coupled to the display module. The display controller is configured to send data requests to the memory controller to fetch the pixel data from the frame buffer and transmit the pixel data to the display module for displaying when the apparatus is in a first mode, such as an active mode, and to selectively drop a portion of the data requests to increase an idle time of the memory chip when the apparatus enters a second mode, such as an e-book mode, so that the memory chip enters a memory power saving mode when the apparatus is in the second mode.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

Figure 1:
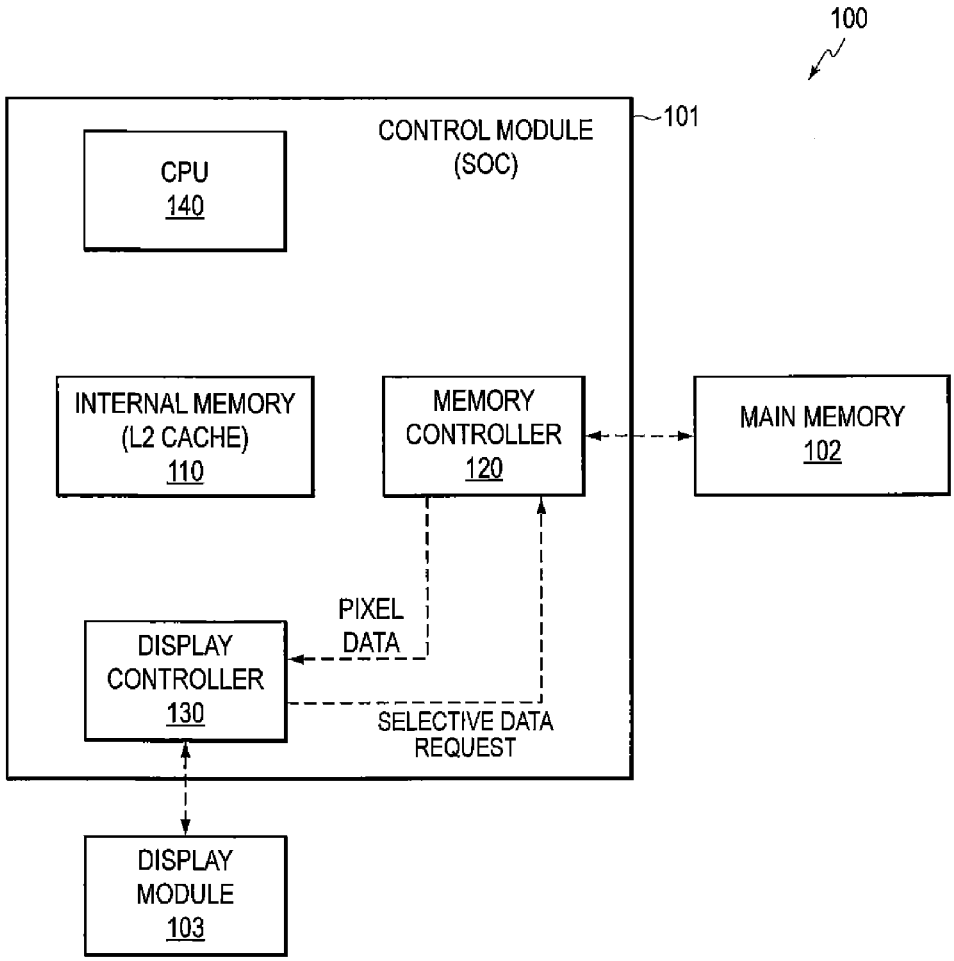
FIG. 1 shows a block diagram of an apparatus example 100 according to an embodiment of the disclosure.

FIG. 1 shows a block diagram of an apparatus example 100 according to an embodiment of the disclosure. The apparatus 100 includes a display module 103, a control module 101 and a main memory 102. The main memory 102 stores pixel data of image frames. The control module 101 accesses the main memory 102 for the pixel data of image frames, and uses the pixel data of image frames to refresh the display module 103.

The apparatus 100 has different operation modes, such as an active mode in which dynamic images are actively displayed, various power-saving modes, and the like. In an embodiment, one of the power-saving modes is referred to as an e-book mode. In the e-book mode, the display module 103 displays a static image for an extended period of time. Pixel data of the static image is stored in the main memory 102. The control module 101 reduces memory accesses to the main memory 102 to fetch the pixel data of the static image. For example, the control module 101 selectively drops memory accesses to the main memory 102 to fetch the pixel data of the every second image frame. Thus, the main memory 102 has relatively longer idle intervals in the e-book mode, and is suitably configured to reduce power consumption.

The apparatus 100 corresponds to any suitable electronic system, such as a laptop computer, a desktop computer, a handheld device, tablet computer, electronic book reader, and the like. In an embodiment, the apparatus 100 is a battery powered electronic system. In another embodiment, the control module 101 and the main memory 102 are integrated on a PCB board that is battery powered. The PCB board is coupled with the display module 103 via a wired or wireless link.

The display module 103 can be any suitable panels, such as liquid crystal display (LCD) panel, cathode ray tube (CRT), plasma display panel (PDP), organic light emitting diode (OLED) and the like, to produce visual images on a screen. Generally, the display module 103 refreshes the visual image on the screen based on a refresh rate. In an example, the display module 103 receives and displays 60 images per second, and thus has a refresh rate of 60 Hz. In an embodiment, the display module 103 receives data signals, such as digital pixel data signals, analog video data signals, and the like, and control signals, such as vertical synchronization signal VSYNC, horizontal synchronization signal HSYNC, data enable signal, blank signal, and the like. Then, based on the control signals, the display module 103 scans and drives pixels on the screen based on the data signals and produces the corresponding image.

The main memory 102 stores data corresponding to the image frames. In an embodiment, the main memory 102 is configured to include a frame buffer. The frame buffer stores pixel data, such as digital pixel data, and the like, corresponding to one or more image frames. When the pixel data, or suitably processed pixel data, is provided to the display module 103 in a stream form, the display module 103 scans and drives pixels on the screen based on the received pixel data. It is noted that the main memory 102 also stores other suitable data, such as application and system codes, intermediate processing data, and the like.

Generally, the main memory 102 has a relatively large storage space for the frame buffer and the other suitable data storage needs. In addition, the main memory 102 is configured to have a relatively large bandwidth to enable fast access. In an embodiment, the main memory 102 has a relatively large storage space to store suitable data and codes that are needed for a processor to operate. In an example, the main memory 102 is implemented as a double date rate (DDR) synchronous dynamic random access memory (SDRAM) chip. In addition, the main memory 102 has a relatively large bandwidth to enable fast data access for various operations. In a DDR SDRAM chip example, the main memory 102 operates at a 533 MHz clock frequency with a 32-bit bus, and thus has a maximum bandwidth of about 4 GB/sec.

In an embodiment, the main memory 102 has multiple operation modes, such as an active access mode, a power-saving mode, and the like. In an example, when the main memory 102 is configured in the active access mode, the main memory 102 operates at a relatively high voltage, and/or a relatively high clock frequency, and supports any suitable memory access activities. Due to the relatively large storage space and the relatively large bandwidth, the main memory 102 consumes a relatively large power in the active access mode.

When the main memory 102 enters the power-saving mode, suitable techniques, such as reducing voltage, reducing clock frequency, powering down, and the like, are applied to reduce power consumption. In an example, the main memory 102 has a self-refresh mode (SRM). When the main memory 102 enters the SRM, only limited activities, such as self-refresh of DRAM cells, are performed. When the main memory 102 is idle, the main memory 102 is powered down. Thus, in the SRM, the main memory 102 consumes a reduced power, such as about 10-20% of the power consumed in the active access mode.

The main memory 102 switches between operation modes automatically or by external control. In an embodiment, the main memory 102 includes suitable circuit to detect an idle time of an interface to external links. When the idle time is longer than a threshold, the main memory 102 enters the SRM, for example. Further, any activity of the interface causes the main memory 102 to exit the SRM and return to the active access mode. In another embodiment, when the main memory 102 receives an external control signal, the main memory 102 enters the SRM; and any access activity causes the main memory 102 to exist the SRM and return to the active access mode.

The control module 101 suitably accesses the main memory 102 to fetch pixel data of image frames, and provides the pixel data (or processed pixel data) and suitable control signals to the display module 103 to display the image frames on the screen. Generally, the control module 101 accesses the main memory 102 according to a refresh rate, such as 60 image frames per second. According to an embodiment of the disclosure, the control module 101 reduces a frame frequency to increase idle intervals of the main memory 102. For example, the control module 101 selectively drops memory accesses to the main memory 102 to fetch image frames in order to increase idle intervals of the main memory 102. In an example, when the apparatus 100 enters the e-book mode, the control module 101 drops memory accesses to fetch every second image frames. Thus, the main memory 102 is idle and enters the power-saving mode every other 16 ms, for example. Then, when the apparatus 100 is in the e-book mode, the main memory 102 is in the power-saving mode for half of the time.

In an embodiment, the control module 101 includes a central processing unit (CPU) 140, an internal memory 110, a memory controller 120, and a display controller 130. It is noted that the control module 101 can include other suitable components. In an example, the control module 101 is implemented as a single integrated chip, such as a system-on-chip (SOC). It is noted that other suitable implementation, such as multiple-chip set for the control module 101 is also contemplated.

The CPU 140 performs major computational operations. In an example, the CPU 140 responds to user input and generates new images for displaying. The internal memory 110 has relatively smaller storage space and relatively fast access speed. In an example, cells in the internal memory 110 are static random access memory (SRAM) cells that consume spaces, but have fast access speed. The internal memory 110 is configured to serve as L2 cache for the CPU 140.

Generally, the CPU 140 has multiple modes, such as an active mode, a sleep mode, and the like. In the active mode, the CPU 140 performs all suitable functions and consumes relatively large power. In the sleep mode, the CPU 140 is configured to perform no functions or few functions. In an example, in the sleep mode, the CPU 140 is partial or totally powered down to save power. The CPU 140 suitably switches between the multiple modes. In an example, when the apparatus 100 does not need perform computation, such as in the e-book mode, the CPU 140 switches to the sleep mode. When the apparatus 100 needs to perform computation, the CPU 140 switches to the active mode.

The memory controller 120 controls memory access to various memory modules, such as the main memory 102, and the like. In an example, the memory controller 120 provides data, address, and writing control signals to the main memory 102 to write data in the address within the main memory 102. In another example, the memory controller 120 provides address and reading control signals to the main memory 102 to read stored data at the address within the main memory 102. In another example, the memory controller 120 provides a mode control signaling, such as a SRM control signaling, to configure the main memory 102 into the SRM mode, for example.

In an embodiment, links between the memory controller 120 and the main memory 102 have a relatively large bandwidth to enable applications having heavy memory access to be performed at a relatively fast speed. For example, the CPU 140 executes an application that processes an image stream. The CPU 140 continuously accesses the main memory 102 to fetch image data, process the image data, and store the processed image data into the main memory 102. In addition, other components of the control module 101 also access the main memory 102 via the memory controller 120 for various reasons. For example, the display controller 130 accesses the frame buffer in the main memory 102 to read pixel data, so that the display module 103 produces images on the screen based on the read pixel data.

The display controller 130 includes suitable hardware circuit to generate control signals, request and receive pixel data, and provide the control signals and the pixel data (or processed pixel data) to the display module 103 to produce images on the screen. In an example, the display controller 130 includes a timing control portion that generates various timing control signals, such as a blanking signal, a vertical synchronization signal VSYNC, a horizontal synchronization signal HSYNC, and the like. In another example, the display controller 130 generates various data controls, such as a data request, a data enable signal, and the like. In another example, the display controller 130 includes suitable portion to process the pixel data, such as converting the pixel data from a digital form to an analog form, and the like.

In an embodiment, to refresh an image frame, the display controller 130 generates a VSYNC pulse that is indicative of a new image frame. Further, the display controller 130 generates a plurality of HSYNC pulses that are indicative of new raster lines of the image frame. In addition, in an example, the display controller 130 generates data requests that respectively correspond to requesting pixel data of the raster lines. The data requests are provided to the memory controller 120. In response to a data request, the memory controller 120 accesses the main memory 102 to fetch pixel data of the raster line. In an embodiment, the memory controller 120 provides addresses and reading control signals to the main memory 102 to fetch pixel data of the raster line, and streams the pixel data to the display controller 130. Generally, the memory controller 120 assigns a bandwidth as a function of the refresh rate and a number of pixels of the display module 103. Using the assigned bandwidth, the memory controller 120 fetches the pixel data from the main memory 102, and streams the fetched pixel data to the display controller 130.

Generally, the display controller 130 includes a relatively small buffer, such as for example a 2K-byte first-in-first-out (FIFO) buffer. It is noted that the FIFO buffer can be any suitable size. The pixel data streams into the FIFO buffer, and streams out of the FIFO buffer and goes to the display module 103. In an example, the FIFO buffer is able to hold pixel data of a raster line. When the FIFO buffer is almost empty, the display controller 130 generates a data request. The memory controller 120 fetches pixel data in response to the data request and fills up the FIFO buffer with pixel data of a raster line. The display controller 130 streams out the pixel data from the FIFO buffer to the display module 103. Thus, to display an image frame, the display controller 130 generates multiple data requests. In an embodiment, the display controller 130 also provides a data enable signal to the display module 103 to accompany the pixel data.

It is noted that, to refresh the image frame, the main memory 102 has been continuously accessed based on the assigned bandwidth. Thus, the main memory 102 is in the active access mode during the refreshing operation.

According to an embodiment of the disclosure, the display controller 130 reduces the memory accesses. In an example, the display controller 130 selectively drops data requests for fetching an image frame to refresh the display module 103, such that the main memory 102 has an increased idle interval corresponding to the dropped data requests. Then, the main memory 102 is suitably configured into a power-saving mode, such as the SRM, and the like, to save power.

In an example, when the apparatus 100 enters the e-book mode, the frame buffer in the main memory 102 is static and the display module 103 displays a static image. The display controller 120 drops data requests corresponding to fetching every second image frame. Thus, when the refresh rate is 60 Hz, the main memory 102 has an idle interval about 16 ms every other 16 ms. Then, the main memory 102 suitably enters the SRM for 16 ms to save power. It is noted that in the e-book mode, about half of the time, the main memory 102 is in the SRM to save power. It is also noted that when the display controller 130 drops every second image frame for the refresh rate of 60 Hz, the display module 103 actually refreshes 30 times per second, and has an effective refresh rate of 30 Hz. When the display module 103 displays images for relatively low movement, such as a static image without any movement in the e-book mode, and the effective refresh rate is higher for human eyes to detect, such as higher than 25 Hz, the drop of image frames does not affect user experience.

Figure 2A:
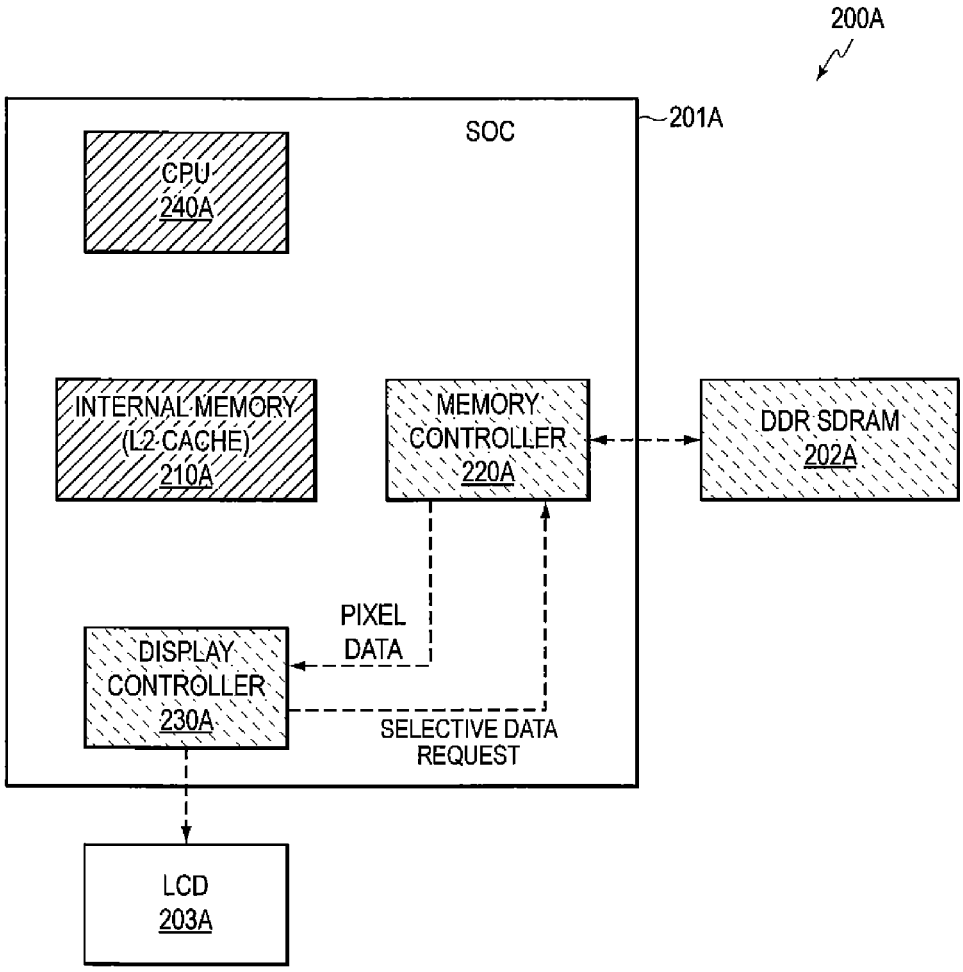
FIG. 2A shows a block diagram of an apparatus example 200A in a power-saving mode according to an embodiment of the disclosure.

FIG. 2A shows a block diagram of an apparatus 200A in an e-book mode according to an embodiment of the disclosure. The apparatus 200A includes a SOC chip 201A, a DDR SDRAM 202A, and a LCD panel 203A. The SOC chip 201A includes a CPU 240A, an internal memory 210A that serves as a L2 cache for the CPU 240A, a memory controller 220A, and a display controller 230A.

In the e-book mode, the CPU 240A and the internal memory 210A enter a sleep mode, and does not update a frame buffer in the main memory 202A. The LCD panel 203A displays a static image according to a last image frame in the frame buffer. The display controller 230A drops, for example, every second image frame for refreshing the LCD panel 203A.

Specifically, in an example, the display controller 230A drops data requests to fetch every second image frame. In an example, the display controller 230A does not generate VSYNC pulse corresponding to the every second image frame. As a result, the display controller 230A does not generate the data requests for requesting pixel data of raster lines for the every second image frame.

In another example, the display controller 230A generates a dummy VSYNC pulse corresponding to the every second image frame. The dummy VSYNC pulse is distinguishable from a real VSYNC pulse, for example, by phase shifting. In response to the dummy VSYNC pulse, the display controller 230A does not generate HSYNC pulses corresponding to the raster lines of the every second image frame. As a result, the display controller 230A does not generate data requests for requesting pixel data of the raster lines for the every second image frame. In an embodiment, the LCD 203A is configured to maintain frame synchronization using the dummy VSYNC pulses without actual data transferring.

In another example, the display controller 230A generates dummy HSYNC pulses corresponding to the dummy VSYNC. The dummy HSYNC pulses are distinguishable from real HSYNC pulses, for example, by phase shifting. In response to the dummy HSYNC pulses, the display controller 230A does not generate the data requests for requesting pixel data of the raster lines for the every second image frame. In an embodiment, the LCD 203A is configured to maintain frame synchronization using the dummy VSYNC pulses and the dummy HSYNC pulses without actual data transferring.

When the display controller 230A drops data requests for an image frame, the DDR SDRAM 202A has an idle interval of 16 ms when the refresh rate is 60 Hz. The DDR SDRAM 202A suitably enters the SRM to save power. In an embodiment, when the memory controller 220A does not receive the data requests, the memory controller 220A also enters a power saving mode.

On the other hand, the display controller 230A provides suitable signals to the LCD panel 203A. When the display controller 230A receives pixel data of an image frame, the display controller 230A streams the pixel data and provides suitable control signals to the LCD panel 203A. In an example, when the display controller 230A drops data requests, and does not receive pixel data of an image frame, the display controller 230A does not need to provide any signal to the LCD panel 203A, and thus the display controller 230A enters a power save mode.

In another example, the display controller 230A provides dummy VSYNC pulse and/or the dummy HSYNC pulses to the LCD panel 203A. The LCD panel 203A is configured to stay in synchronization with the display controller 230A by utilizing the dummy VSYNC pulse and/or the dummy HSYNC pulses. In addition, the display controller 230A sets a data enable signal to a disable level. Thus, the LCD panel 203A does not change the displayed image.

Figure 2B:
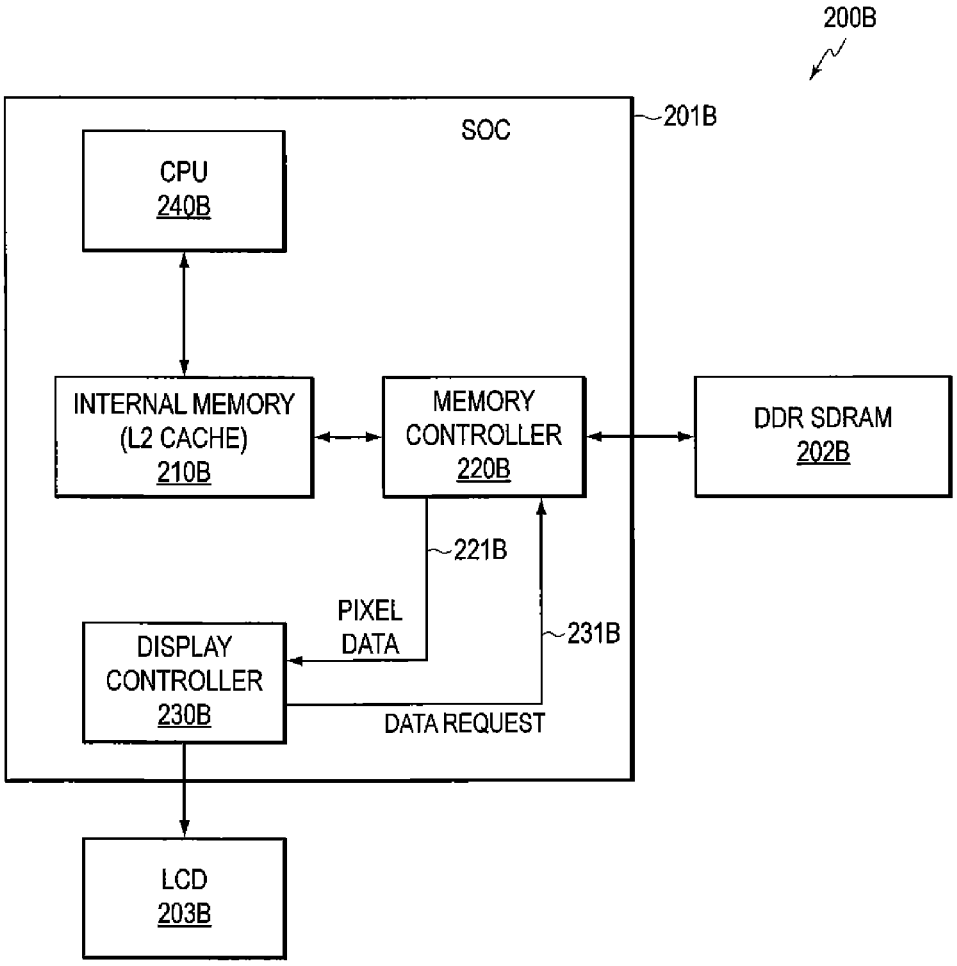
FIG. 2B shows a block diagram of an apparatus example 200B in an active operation mode according to an embodiment of the disclosure.

FIG. 2B shows a block diagram of an apparatus 200B in an active operation mode according to an embodiment of the disclosure. The apparatus 200B and the apparatus 200A are a same apparatus in different modes. The apparatus 200B includes same components as the apparatus 200A.

In the active operation mode, the CPU 240B is active, and the internal memory 210B serves as the L2 cache for the CPU 240B. The DDR SDRAM 202B includes the frame buffer that buffers pixel data corresponding to one or more image frames to be displayed by the LCD panel 203B. The display controller 230B continuously generates data requests for fetching pixel data of image frames and provides the data requests to the memory controller 220B. For example, the display controller 230B generates data requests for fetching 60 image frames per second when the refresh rate is 60 Hz. The memory controller 220B allocates a portion of its bandwidth for fetching the pixel data from the DDR SDRAM 202B. The portion of the bandwidth is equivalent to the data rate for refreshing the LCD panel 203B. Thus, the memory controller 220B streams pixel data of 60 image frames per second to the display controller 230B. Then, the display controller 230B forwards the fetched pixel data, and suitable control signals to the LCD panel 203B.

Figure 3A:
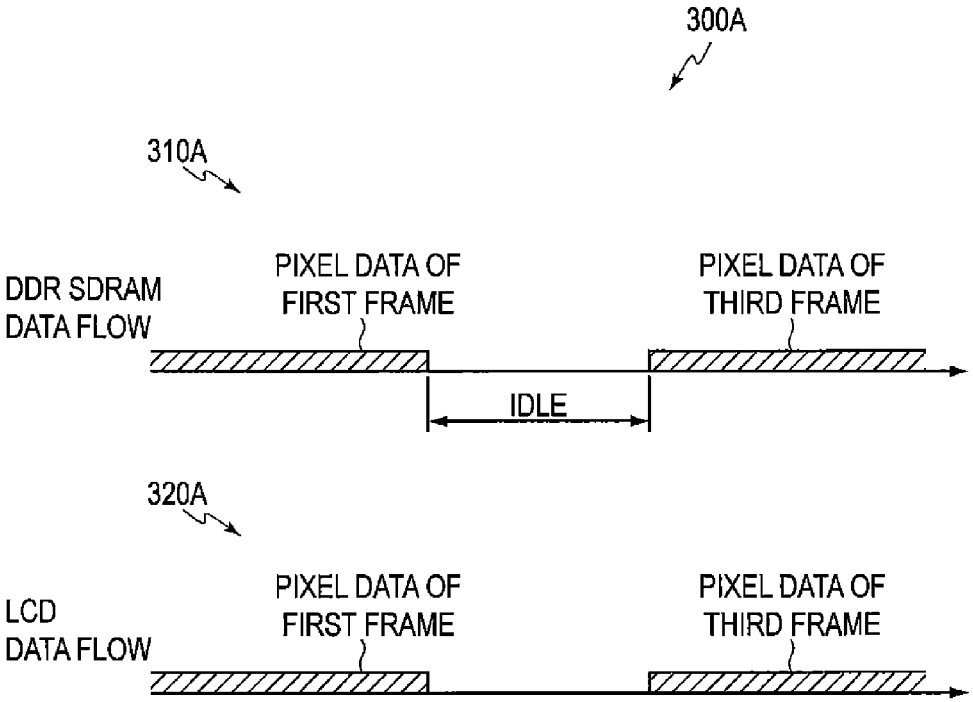
FIGS. 3A and 3B show plots of data flows corresponding to FIGS. 2A and 2B.

FIG. 3A shows a plot 300A of data flows corresponding to FIG. 2A. The plot 300A includes a DDR SDRAM data flow 310A for DDR SDRAM 202A and an LCD data flow 320A for the LCD panel 203A. Due to the reason that the display controller 230A drops data requests corresponding to every second image frame, the main memory data flow 310A includes pixel data of odd numbers of image frames, and does not include pixel data of even numbers of image frames. The DDR SDRAM 202A is idle during a time corresponding to fetching the pixel data of even numbers of image frames, and enters into the SRM, for example. The LCD data flow 320A is similar to the DDR SDRAM data flow 310A.

It is noted that, the odd numbers and the even numbers are used as examples. In another embodiment, the main memory data flow 310A includes pixel data of even numbers of image frames and does not include pixel data of odd numbers of image frames.

Figure 3B:
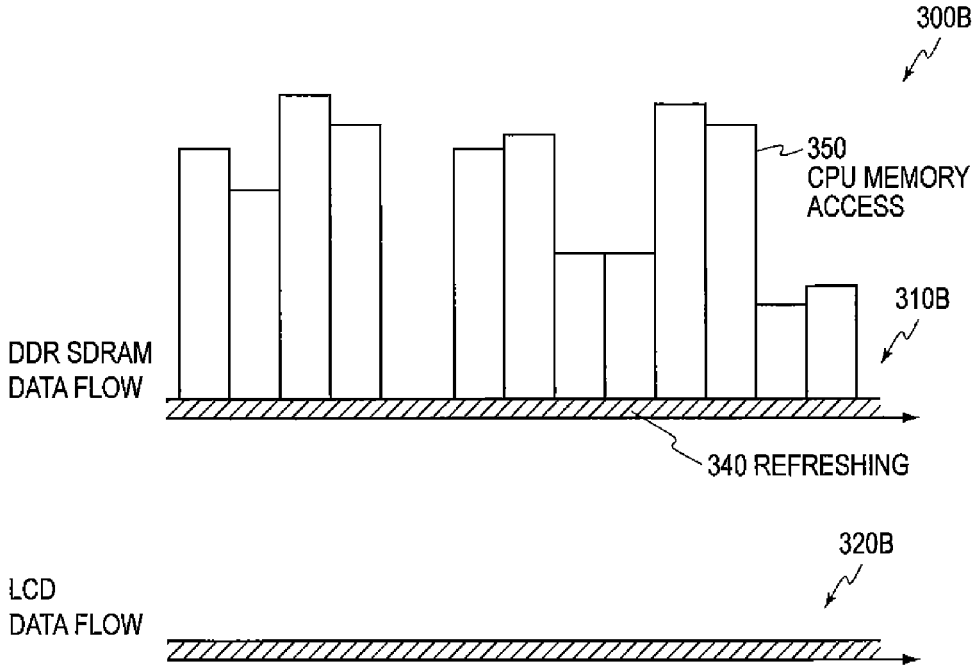

FIG. 3B shows a plot 300B of data flows corresponding to FIG. 2B. The plot 300B includes a DDR SDRAM data flow 310B for DDR SDRAM 202B and an LCD data flow 320B for the LCD panel 203B. The LCD data flow 320B has a relatively constant data rate corresponding to the refresh rate of the LCD panel 203B. The DDR SDRAM data flow 310B includes a relatively constant bandwidth portion 340 allocated for refreshing the LCD panel 203B. In addition, other portions of the bandwidth are suitably allocated for operations of the CPU 240B, for example.

Figure 4A:
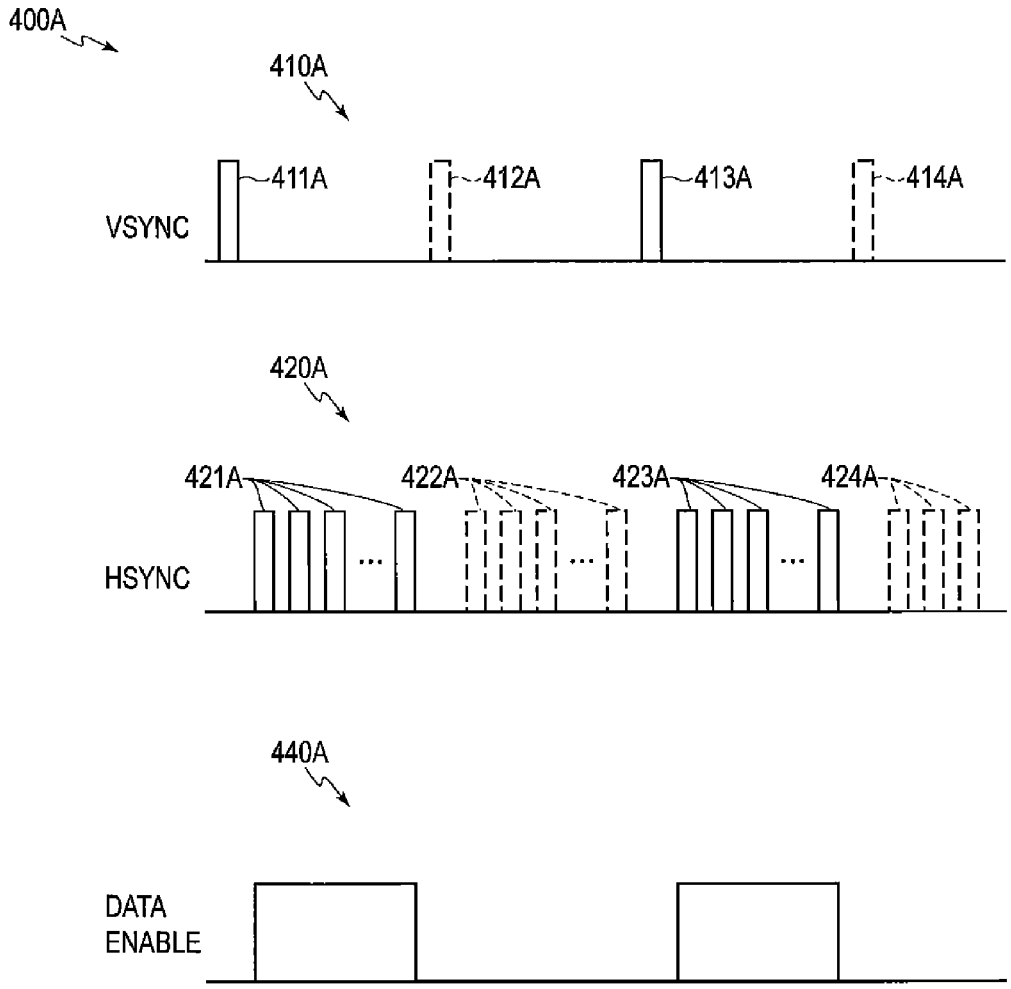
FIG. 4A shows a plot 400A tracking control signals generated during a power-saving mode according to an embodiment of the disclosure.

FIG. 4A shows a plot 400A tracking control signals generated by the display controller 130 during a power-saving mode according to an embodiment of the disclosure. The plot 400A includes waveforms 410A, 420A and 440A. The waveform 410A tracks the VSYNC signal, the waveform 420A tracks the HSYNC signal, and the waveform 440A tracks the data enable signal.

The data enable signal 440A is at an enable level corresponding to image frames of odd numbers, and at a disable level corresponding to image frames of even numbers.

In an embodiment, the VSYNC signal 410A includes pulses corresponding to frames of odd numbers, and drops pulses corresponding to image frames of even numbers. It is noted that, in another embodiment, the VSYNC signal 410A can include pulses corresponding to image frames of even numbers and drop pulses corresponding to image frames of odd numbers. In the FIG. 4A example, the VSYNC signal 410A includes a first pulse 411A corresponding to a first image frame, and a second pulse 413A corresponding to a third image frame. In another embodiment, the VSYNC signal 410A includes dummy pulses corresponding to image frames of even numbers. The dummy pulses do not accompany with pixel data. In the FIG. 4A example, the VSYNC signal 410A includes a first dummy pulse 412A corresponding to a second image frame, and a second dummy pulse 414A corresponding to a fourth image frame.

In an embodiment, the HSYNC signal 420A includes pulses corresponding to image frames of odd numbers, and drops pulses corresponding to image frames of even numbers. In another embodiment, the HSYNC signal 420A includes pulses corresponding to image frames of even numbers, and drops pulses corresponding to image frames of odd numbers. In the FIG. 4A example, the HSYNC signal 420A includes first pulses 421A corresponding to a first image frame, and second pulses 423A corresponding to a third image frame. In another embodiment, the HSYNC signal 420A also includes dummy pulses corresponding to image frames of even numbers. The dummy pulses do not accompany with data. In the FIG. 4A example, the HSYNC signal 20A includes first dummy pulses 422A corresponding to a second image frame, and second dummy pulses 424A corresponding to a fourth image frame.

Figure 4B:
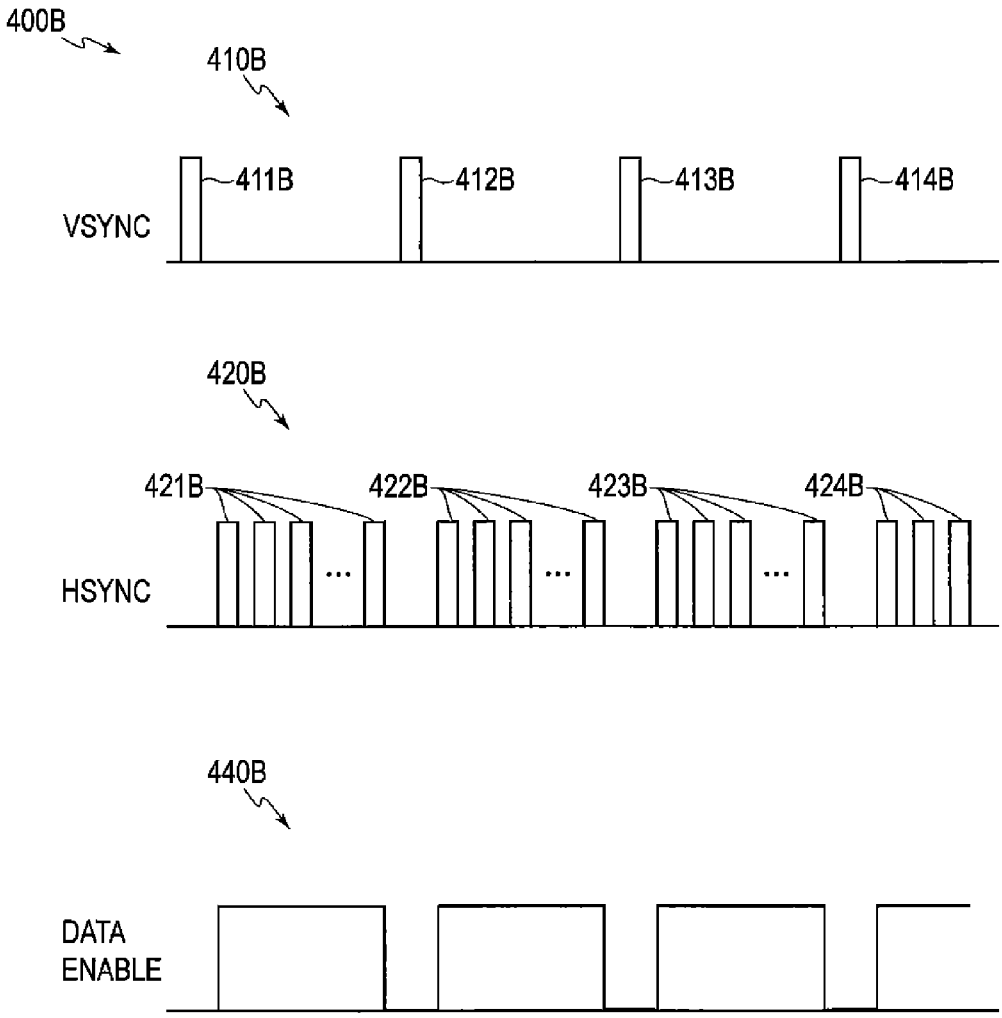
FIG. 4B shows a plot 400B tracking control signals generated during an active operation mode according to an embodiment of the disclosure.

FIG. 4B shows a plot 400B tracking control signals generated by the display controller 130 during an active mode according to an embodiment of the disclosure. Similar to FIG. 4A, the plot 400B includes waveforms 410B-440B. The waveform 410B tracks the VSYNC signal, the waveform 420B tracks the HSYNC signal, and the waveform 440B tracks the data enable signal.

The data enable signal 440B is at an enable level corresponding to all the image frames.

The VSYNC signal 410B includes pulses corresponding to all the image frames.

The HSYNC signal 420B includes pulses corresponding to all the image frames.

Figure 5:
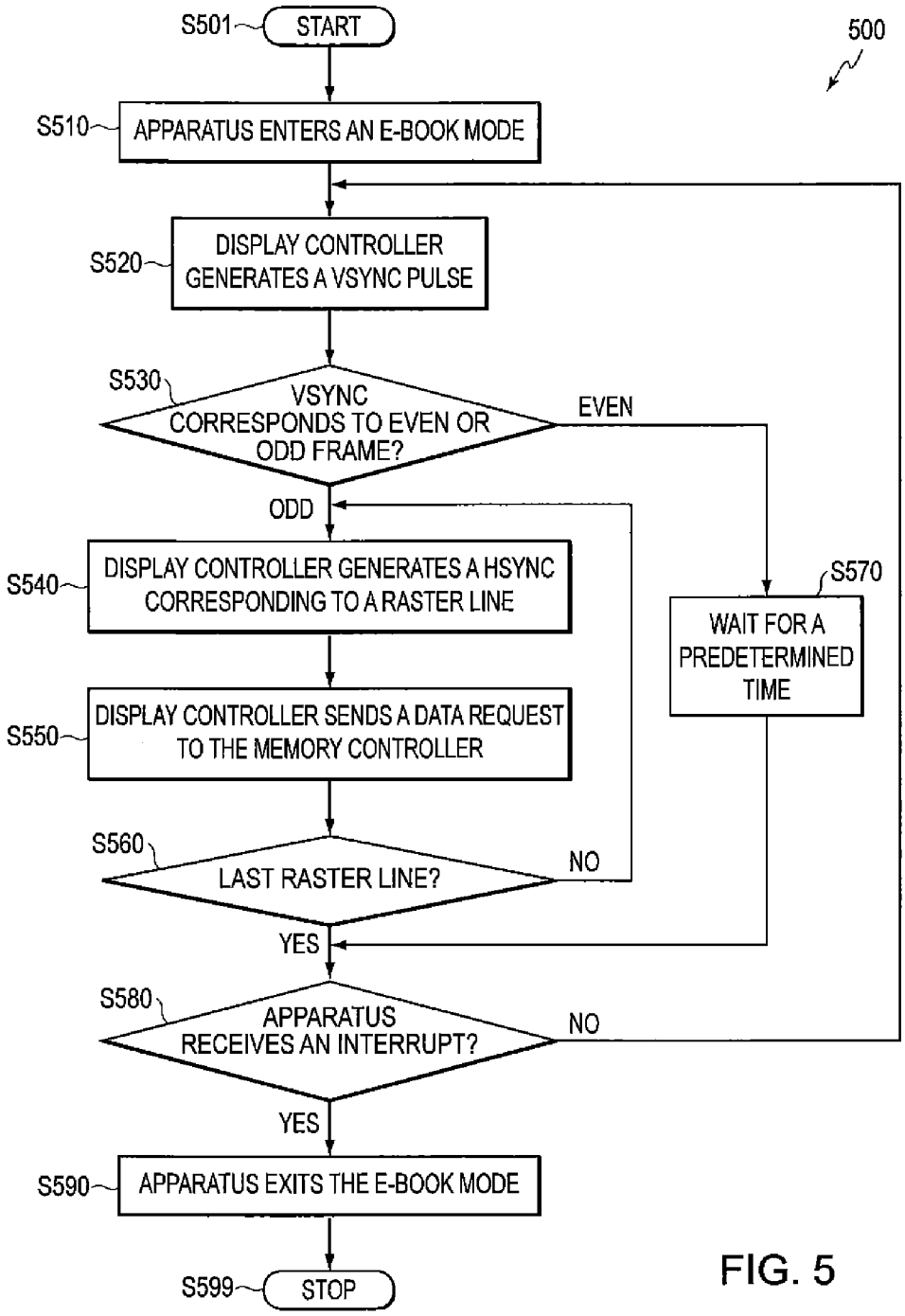
FIG. 5 shows a flowchart outlining a process example for refreshing a display panel according to an embodiment of the disclosure.

FIG. 5 shows a flowchart outlining a process example 500 for the apparatus 100 to refresh the display module 103 in an e-book mode according to an embodiment of the disclosure. The process starts at S501 and proceeds to S510.

At S510, the apparatus 100 enters the e-book mode. In an embodiment, when an idle time of the CPU 140 is larger than a threshold, the apparatus 100 enters the e-book mode.

At S520, the display controller 130 generates a VSYNC pulse that is indicative of a new image frame.

At S530, the display controller 130 determines whether the VSYNC pulse corresponds to an image frame of an even number or an odd number. When the generated VSYNC pulse corresponds to an image frame of an odd number, the process proceeds to S540; otherwise, the process proceeds to S570.

At S540, the display controller 130 generates a HSYNC pulse corresponding to a raster line.

At S550, the display controller 130 sends a data request to the memory controller 120. The memory controller 120 suitably fetches pixel data from the main memory 102, and streams the pixel data to the display controller 130. The display controller 130 streams the pixel data and suitable control signals, such as the data enable signal at an enable level, the and the like, to the display module 103.

At S560, the display controller 130 determines whether the raster line is the last raster line. When the raster line is the last one, the process proceeds to S580; otherwise, the process returns to S540.

At S570, the display controller 130 waits for a predetermined time, such as about 16 ms for 60 Hz refresh rate. In an embodiment, the display controller 130 enters a power saving mode for about 16 ms.

At S580, the apparatus 100 determines whether an interrupt is received. When the apparatus 100 receives an interrupt, such as a user input, the process proceeds to S590; otherwise the process returns to S520.

At S590, the apparatus 100 exists the e-book mode. Then, the process proceeds to S599 and terminates.

It is noted that the process 500 can be suitably modified. In an example, S520 and S530 are suitably modified. For example, the display controller 130 first determines whether a next image frame has an odd number or an even number. When the next image frame has an odd number, the display controller 130 generates a VSYNC pulse. When the next image frame has an even number, the display controller 130 generates a dummy VSYNC pulse or did not generate any VSYNC pulse.

In another example, the process 500 is suitably modified, such that S540-S560 are executed for even numbers of image frames and S570 is executed for odd numbers of image frames.

While the invention has been described in conjunction with the specific embodiments thereof that are proposed as examples, it is evident that many alternatives, modifications, and variations will be apparent to those skilled in the art. Accordingly, embodiments of the invention as set forth herein are intended to be illustrative, not limiting. There are changes that may be made without departing from the scope of the invention.

What is claimed is:

1. An integrated circuit, comprising:

a memory controller coupled to a memory that includes a frame buffer storing pixel data of images for displaying, the memory controller configured to access the memory to fetch the pixel data from the frame buffer in response to data requests; and a display controller coupled to a display module, the display controller configured to send data requests to the memory controller to fetch the pixel data from the frame buffer and transmit the pixel data to the display module in a first mode, to selectively drop a portion of the data requests to increase an idle time of the memory in a second mode, so that the memory enters a memory power saving mode in the second mode, and to selectively send dummy vertical synchronization pulses/dummy horizontal synchronization pulses to the display module in the second mode, the dummy vertical synchronization pulses/dummy horizontal synchronization pulses being actual pulses that are transmitted without actual data transferring in the pulses and between the pulses, the dummy vertical synchronization pulses occurring, substantially right after a falling edge of a data enable signal that is used to enable/disable transmitting of the pixel data.

2. The integrated circuit of claim 1, further comprising:

a central processing unit (CPU) that is configured to be active in the first mode and that is configured to be inactive in the second mode.

3. The integrated circuit of claim 1, wherein the display controller is configured to drop the portion of the data requests to fetch pixel data of every second image frame.

4. The integrated circuit of claim 1, wherein the memory controller is coupled to the memory, and the memory is external to the integrated circuit.

5. The integrated circuit of claim 1, wherein the memory controller enters a power saving mode in the second mode.

6. The integrated circuit of claim 1, wherein the display controller enters a power saving mode in the second mode.

7. The integrated circuit of claim 1, wherein the display controller selectively disables a data enable signal in the second mode.

8. A method for refreshing a display, comprising:

sending first data requests to a memory controller to fetch pixel data of a first image frame from a memory;

sending the fetched pixel data of the first image frame to a display module for display;

dropping second data requests corresponding to fetching pixel data of a second image frame, so that the memory has an increased idle time and enters a memory power saving mode; and selectively sending dummy vertical synchronization pulses/dummy horizontal synchronization pulses to the display module in the memory power saving mode, the dummy vertical synchronization pulses/dummy horizontal synchronization pulses being actual pulses that are transmitted without actual data transferring in the pulses and between the pulses, the dummy vertical synchronization pulses occurring substantially right after a falling edge of a data enable signal that is used to enable/disable transmitting of the pixel data.

9. The method of claim 8, wherein dropping the second data requests corresponding to fetching the pixel data of the second image frame further comprises:

determining the first image frame is substantially same as the second image frame; and dropping the second data requests corresponding to fetching the pixel data of the second image frame.

10. The method of claim 8, wherein dropping the second data requests corresponding to fetching the pixel data of the second image frame further comprises:

dropping the second data requests corresponding to fetching pixel data of the second image frame when a central processing unit (CPU) is inactive.

11. The method of claim 8, wherein dropping the second data requests corresponding to fetching the pixel data of the second image frame further comprises:

entering a power saving mode while dropping the second data requests.

12. An apparatus, comprising:

a display module configured to display an image frame on a screen based on pixel data of the image frame;

a memory chip configured to include a frame buffer that stores pixel data of image frames to be displayed by the display module; and an integrated circuit having a memory controller coupled to the memory chip, the memory controller configured to access the memory chip to fetch the pixel data from the frame buffer in response to data requests; and a display controller coupled to the display module, the display controller configured to send data requests to the memory controller to fetch the pixel data from the frame buffer and transmit the pixel data to the display module when the apparatus is in a first mode, to selectively drop a portion of the data requests to increase an idle time of the memory chip when the apparatus enters a second mode, so that the memory chip enters a memory power saving mode when the apparatus is in the second mode, and to selectively send dummy vertical synchronization pulses/dummy horizontal synchronization pulses to the display module in the second mode, the dummy vertical synchronization pulses/dummy horizontal synchronization pulses being actual pulses that are transmitted without actual data transferring in the pulses and between the pulses, the dummy vertical synchronization pulses occurring substantially right after a falling edge of a data enable signal that is used to enable/disable transmitting of the pixel data.

13. The apparatus of claim 12, further comprising:

a central processing unit (CPU) that is active in the first mode and that is inactive in the second mode.

14. The apparatus of claim 12, wherein the display controller is configured to drop the portion of the data requests corresponding to fetching every second image frame.

15. The apparatus of claim 12, wherein the display controller selectively disables a data enable signal when the apparatus is in the second mode.

16. The apparatus of claim 12, wherein when the apparatus is in the second mode, the memory controller and the display controller enter power saving modes.

17. The apparatus of claim 12, wherein the display module is a liquid-crystal display (LCD) panel.

18. The apparatus of claim 12, wherein the display module is configured to detect and utilize the dummy vertical synchronization pulses/the horizontal synchronization pulses to maintain frame synchronization.

* * * * *